US007381176B2

(12) United States Patent
Graham et al.

(10) Patent No.: US 7,381,176 B2
(45) Date of Patent: Jun. 3, 2008

(54) METHOD AND MACHINE FOR CONSTRUCTING A COLLAPSIBLE BULK BIN

(75) Inventors: Thomas D. Graham, Winter Garden, FL (US); Amer Aganovic, Orlando, FL (US); John Thomas Yoder, IV, Wildwood, MO (US); Tesfahun Y. Mengistu, Sioux City, IA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 11/533,244

(22) Filed: Sep. 19, 2006

(65) Prior Publication Data

US 2008/0070769 A1 Mar. 20, 2008

(51) Int. Cl.
*B31B 17/26* (2006.01)

(52) U.S. Cl. ..... 493/84; 493/89; 493/123; 493/128; 493/183

(58) Field of Classification Search ..... 493/84, 493/89, 110, 111, 114, 121, 123, 128, 141, 493/183; 229/110, 117, 122.27, 122.28; 100/25, 33 PB; 53/589, 590, 176
See application file for complete search history.

(56) References Cited

U.S. PATENT DOCUMENTS 1,084,140 A * 1/1914 Penlason ..... 229/122.28
1,341,954 A * 6/1920 Weightman et al. ..... 493/110
1,652,844 A * 12/1927 Van Wormer ..... 229/122.28
3,482,489 A * 12/1969 Reichert et al. ..... 493/141
4,392,606 A * 7/1983 Fremion ..... 229/122.27
4,461,137 A * 7/1984 Wood ..... 493/110
4,702,408 A * 10/1987 Powlenko ..... 229/101
4,798,571 A * 1/1989 Everman et al. ..... 493/114
4,951,562 A * 8/1990 Ribaldo ..... 100/25
5,289,668 A * 3/1994 Meyer ..... 53/410
5,400,706 A * 3/1995 Tipton et al. ..... 100/25
5,715,991 A 2/1998 Gasper
5,761,889 A * 6/1998 Blaisdell et al. ..... 53/589
5,772,108 A 6/1998 Ruggiere, Sr. et al.
5,915,617 A 6/1999 Gasper
6,012,629 A * 1/2000 Newcomer ..... 229/117
6,074,331 A 6/2000 Ruggiere, Sr. et al.
6,386,437 B1 5/2002 Larson, Jr.
6,688,084 B2 2/2004 Yarbrough
RE38,631 E 10/2004 Ruggiere, Sr. et al.
6,918,228 B2 7/2005 Yarbrough

* cited by examiner

*Primary Examiner*—Louis Huynh
(74) *Attorney, Agent, or Firm*—Armstrong Teasdale LLP

(57) ABSTRACT

A machine for making a reinforced, collapsible bulk bin assembly is provided. The machine includes a body blank feeding device for providing a body blank from a stack of body blanks, an erecting device for partially erecting the body blank, and a bottom insertion device for inserting a partially folded bottom blank into the partially erected body blank. The machine also includes first fingers for attaching major flaps of the body blank to the bottom blank, second fingers for attaching minor flaps of the body blank to major flaps of the body blank after the body blank has been collapsed, and a strapping device for simultaneously applying a plurality of straps to an exterior surface of the body blank.

19 Claims, 7 Drawing Sheets

METHOD AND MACHINE FOR CONSTRUCTING A COLLAPSIBLE BULK BIN

BACKGROUND OF THE INVENTION

This invention relates generally to packaging and, more particularly, to methods and a machine for constructing a collapsible bulk bin that includes a self-erecting bottom wall.

Containers are frequently utilized to store and aid in transporting products. These containers can be square, hexagonal, or octagonal. At least some known bulk containers used to transport products are designed to fit a standard sized pallet. The shape of the container can provide additional strength to the container. For example, a hexagonal-shaped bulk container provides greater resistance to bulge over conventional rectangular or square containers. An empty bulk bin can be shipped in a knocked-down flat state and opened to form an assembled bulk bin that is ready for use. Shipping and storing bulk bins in a knocked-down flat state saves money and space, however, the size and configuration of bulk bins can make the setup of the bin difficult for an individual to complete and often requires more than one person for assembly. A bulk bin that requires more than one person to complete assembly can cause unwanted expenses and wasted time for a user of the bulk bin.

BRIEF DESCRIPTION OF THE INVENTION

In one aspect, a machine for making a reinforced, collapsible bulk bin assembly is provided. The bulk bin assembly is capable of being erected to a deployed articulated configuration and is formed from a body blank and a bottom blank. The body blank includes major bottom flaps and minor bottom flaps. The bulk bin includes a bottom and a plurality of side panels extending from the bottom. The machine includes a body blank feeding device for providing a body blank from a stack of body blanks, an erecting device for partially erecting the body blank, and a bottom insertion device for inserting a partially folded bottom blank into the partially erected body blank. The machine also includes first fingers for attaching the major flaps to the bottom blank, second fingers for attaching each minor flap to a major flap of the body blank after the body blank has been collapsed, and a strapping device for simultaneously applying a plurality of straps to an exterior surface of the body blank.

In another aspect, a method for making a reinforced, collapsible bulk bin assembly is provided. The bulk bin assembly is capable of being erected to a deployed articulated configuration and is formed from a body blank and a bottom blank. The body blank includes major bottom flaps and minor bottom flaps. The bulk bin includes a bottom and a plurality of side panels extending from the bottom. The method includes providing a body blank from a stack of body blanks, partially erecting the body blank, and inserting a partially folded bottom blank into the partially erected body blank. The method also includes attaching the major flaps to the bottom blank, attaching each minor flap to a major flap of the body blank after the body blank has been collapsed, and simultaneously applying a plurality of straps to an exterior surface of the body blank.

In another aspect, a machine for making a reinforced, collapsible bulk bin assembly is provided. The bulk bin assembly is capable of being erected to a deployed articulated configuration and is formed from a body blank and a bottom blank. The body blank includes major bottom flaps and minor bottom flaps. The bulk bin includes a bottom and a plurality of side panels extending from the bottom. The machine includes a body blank feeding station for providing a body blank from a stack of body blanks, an erecting station for partially erecting the body blank, and a bottom insertion station for inserting a partially folded bottom blank into the partially erected body blank. The machine also includes a first attachment station for attaching the major flaps to the bottom blank, a second attachment station for attaching each minor flap to a major flap of the body blank after the body blank has been collapsed, and a strapping station for simultaneously applying a plurality of straps to an exterior surface of the body blank.

BRIEF DESCRIPTION OF THE DRAWINGS

Corresponding reference characters indicate corresponding parts throughout the several views of the drawings.

DETAILED DESCRIPTION OF THE INVENTION

A collapsible bulk bin and methods of constructing a collapsible bulk bin are described herein. More specifically, a collapsible bulk bin, including reinforcing straps and a self-erecting solid bottom wall, and methods of constructing the same are described herein. However, it will be apparent to those skilled in the art and guided by the teachings herein provided that the invention is likewise applicable to any storage container including, without limitation, a carton, a tray, a box, or a bin.

In one embodiment, the container is fabricated from a paperboard material. The container, however, may be fabricated using any suitable material, and therefore is not limited to a specific type of material. In alternative embodiments, the container is fabricated using cardboard, corrugated board, plastic and/or any suitable material known to those skilled in the art and guided by the teachings herein provided. The container may have any suitable size, shape, and/or configuration (i.e., number of sides), whether such sizes, shapes, and/or configurations are described and/or illustrated herein. For example, in one embodiment, the container includes a shape that provides functionality, such as a shape that facilitates transporting the container and/or a shape that facilitates stacking and/or arrangement of a plurality of containers.

Figure 1:
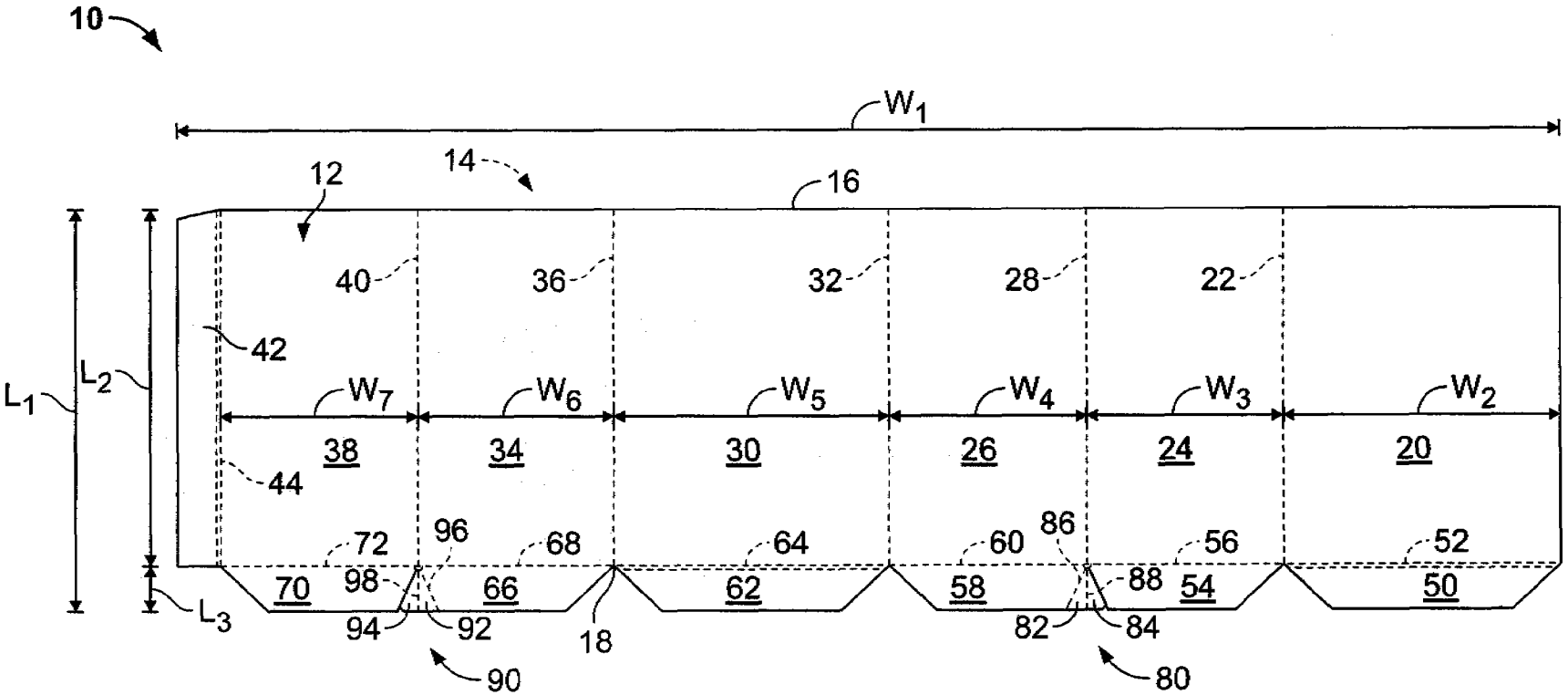
FIG. 1 is a top plan view of a first blank of sheet material for forming a container according to one embodiment of this invention.

Referring now to the drawings, FIG. 1 is a top plan view of a first blank of sheet material 10 for forming a container according to one embodiment of this invention. Specifically, blank 10 is a body blank utilized to form a body of the container. In one embodiment, blank 10 is made of cardboard, corrugated board, plastic, and/or any suitable material. Further, in one embodiment, blank 10 has a width $W_1$ of 149.5 inches and a length $L_1$ of 44 inches. Blank 10 includes an interior surface 12 and an exterior surface 14. Blank 10 also includes a top edge 16 and a bottom edge 18. Blank 10 includes a first side panel 20, coupled across a fold line 22, to a second side panel 24. In one embodiment, first side panel 20 has a width $W_2$ of 29.5 inches and a length $L_2$, and second side panel 24 has a width $W_3$ of 21.5 inches and a length $L_2$. Further, blank 10 includes a third side panel 26, coupled across a fold line 28, to second side panel 24. In one embodiment, third side panel 26 has a width $W_4$ of 21.5 inches and a length $L_2$. Blank 10 also includes a fourth side panel 30, coupled across a fold line 32, to third side panel 26, and a fifth side panel 34, coupled across a fold line 36, to fourth side panel 30. In one embodiment, fourth side panel 30 has a width $W_5$ of 29.5 inches and a length $L_2$, and fifth side panel 34 has a width $W_6$ of 21.5 inches and a length $L_2$. Blank 10 also includes a sixth side panel 38, coupled across a fold line 40, to fifth side panel 34. In one embodiment, sixth side panel 38 has a width $W_7$ of 21.5 inches and a length $L_2$. Sixth side panel 38 includes a glue tab 42 extending across a fold line 44, from an edge opposed to fifth side panel 34. In one embodiment, glue tab 42 has a width $W_8$ of four inches and a length $L_2$, and fold line 44 has a width $W_9$ of one half inch and a length $L_2$.

Blank 10 also includes a plurality of end flaps or major flaps. A first end flap 50 extends from bottom edge 18 of first side panel 20 across a fold line 52. In one embodiment, a portion of first end flap 50 extends a length $L_3$ of five inches from first side panel 20. A second end flap 54 extends from bottom edge 18 of second side panel 24 across a fold line 56. In one embodiment, a portion of second end flap 54 extends length $L_3$ from second side panel 24. A third end flap 58 extends from bottom edge 18 of third side panel 26 across a fold line 60. In one embodiment, a portion of third end flap 58 extends length $L_3$ from third side panel 26. A fourth end flap 62 extends from bottom edge 18 of fourth side panel 30 across a fold line 64. In one embodiment, a portion of fourth end flap 62 extends length $L_3$ from fourth side panel 30. A fifth end flap 66 extends from bottom edge 18 of fifth side panel 34 across a fold line 68. In one embodiment, a portion of fifth end flap 66 extends length $L_3$ from fifth side panel 34. A sixth end flap 70 extends from bottom edge 18 of sixth side panel 38 across a fold line 72. In one embodiment, a portion of sixth end flap 70 extends length $L_3$ from sixth side panel 38.

In alternative embodiments, blank 10 and any portions thereof have any dimensions suitable for forming a bulk bin as described herein.

As shown in FIG. 1, third end flap 58 includes a tab joint or minor flap 80, having a first portion 82 and a second portion 84. First portion 82 is coupled to third end flap 58 across a fold line 86, and second portion 84 is coupled to first portion 82 across a fold line 88. Further, fifth end flap 66 includes a tab joint or minor flap 90 having a first portion 92 and a second portion 94. First portion 92 is coupled to fifth end flap 66 across a fold line 96, and second portion 94 is coupled to first portion 92 across a fold line 98.

Figure 2:
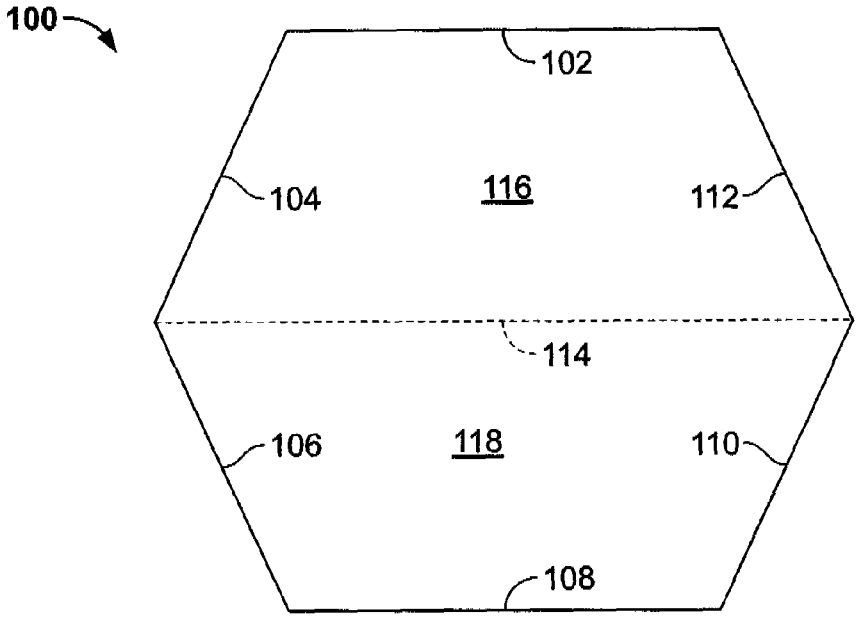
FIG. 2 is a top plan view of a second blank of sheet material for forming a container according to one embodiment of this invention.

FIG. 2 is a top plan view of a second blank of sheet material 100 for forming a container according to one embodiment of this invention. Specifically, blank 100 is a bottom blank utilized to form the container. In one embodiment, blank 100 is a hexagonal shaped blank of sheet material. Blank 100 includes a first edge 102, a second edge 104, a third edge 106, a fourth edge 108, a fifth edge 110, and a sixth edge 112. Blank 100 includes a fold line 114, connecting the junction of second edge 104 and third edge 106 with the junction of fifth edge 110 and sixth edge 112. Fold line 114 separates blank 100 into a first portion 116 and a second portion 118.

Figure 3:
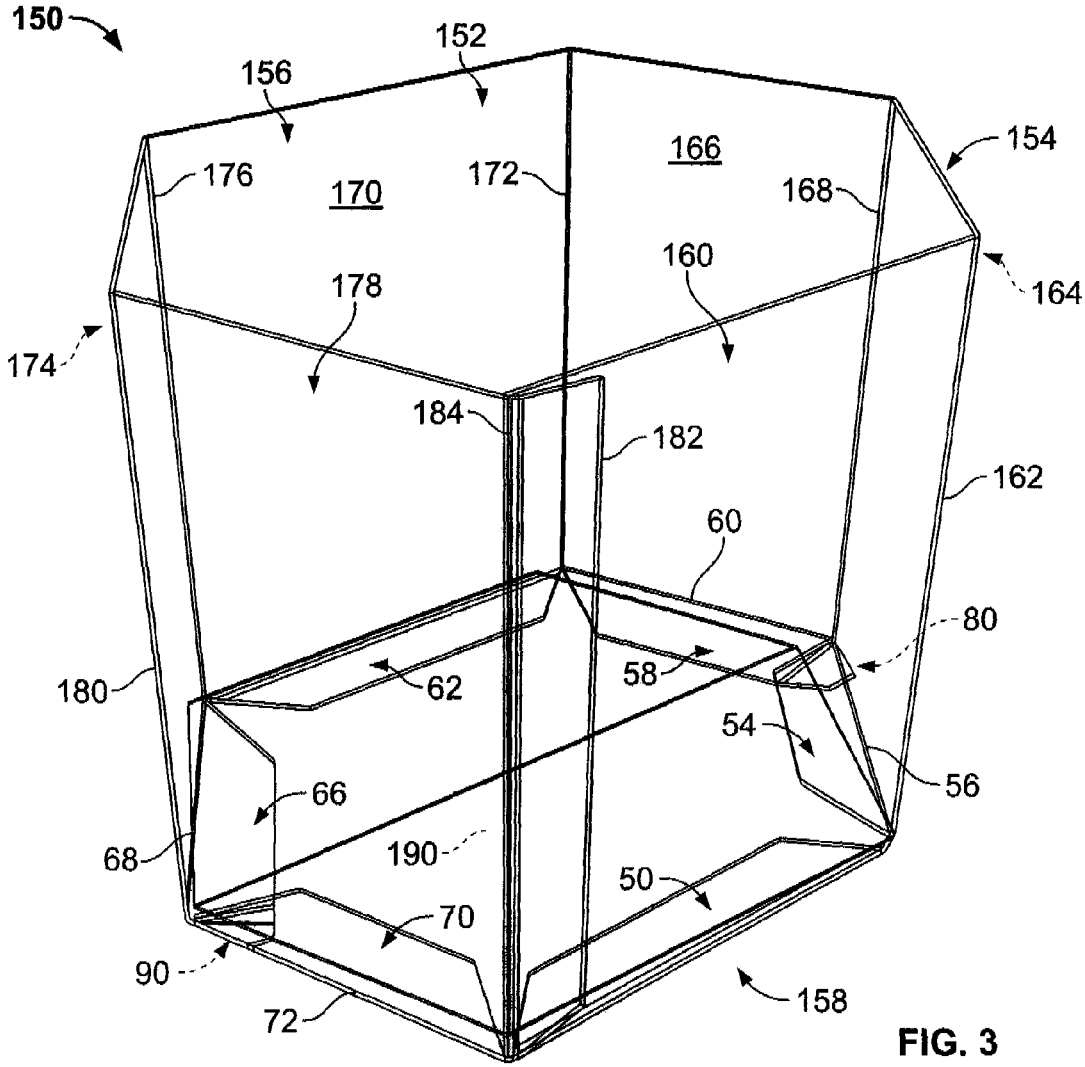
FIG. 3 is a perspective view of the container formed from the first and second blanks as shown in FIGS. 1 and 2.

FIG. 3 is a perspective view of a container 150 formed from first blank 10 of FIG. 1 and second blank 100 of FIG. 2. Container 150 includes an interior 152 and an exterior 154. Container 150 also includes a top opening 156 and a bottom portion 158. Container 150 includes a first side wall 160, coupled across a fold line 162, to a second side wall 164. Container 150 includes a third side wall 166, coupled across a fold line 168, to second side wall 164. Container 150 includes a fourth side panel 170, coupled across a fold line 172, to third side wall 166. Container 150 includes a fifth side wall 174, coupled across a fold line 176, to fourth side wall 170. Container 150 includes a sixth side wall 178, coupled across a fold line 180, to fifth side wall 174. Sixth side wall 178 includes a glue tab 182 extending across a fold line 184, from an edge opposed to fifth side wall 174. Interior 152 of glue tab 182 is coupled to exterior 154 of first side wall 160. In one embodiment, glue tab 182 is adhesively coupled to first side wall 160 using glue. However, any other chemical or mechanical fastener is acceptable for this coupling and any others described below.

Referring further to FIG. 3, blank 100 of FIG. 2 is aligned to form a bottom wall 190. The plurality of end flaps 50, 54, 58, 62, 66, and 70 hold bottom wall 190 within container 150. An interior surface of first bottom flap 50 is coupled to an exterior surface of bottom wall 190. An interior surface of fourth bottom flap 62 is coupled to the exterior surface of bottom wall 190. An interior surface of tab joint 80 is coupled to an exterior surface of second end flap 54 and an interior surface of tab joint 90 is coupled to an exterior surface of sixth end flap 70. The combination of coupling end flaps 50 and 62 to bottom wall 190, and coupling tab joint 80 to end flap 54 and tab joint 90 to end flap 70, holds bottom wall 190 within container 150.

In one embodiment, container 150 may include a liner made of plastic or a similar material for providing a moisture-resistant barrier. Bottom wall 190 is configured to not puncture or cut such liner, which may be placed within container 150. In one embodiment, bottom wall 190 is a solid one-piece construction that has a substantially smooth internal surface. In one embodiment, the internal surface of bottom wall 190 does not include any slits, slots, die-cuts corners, or edges that may pierce or puncture a liner that is positioned within the container.

In one embodiment, bottom wall 190 comprises a single-wall bottom. This design allows a manufacturer to use less material in constructing the bulk container. Because these types of bulk containers are designed to be placed on a pallet for carrying the container, a single-wall construction for bottom wall 190 can be used. In some embodiments, bottom wall 190 is a single-wall bottom and sides 160, 170, 164, 166, 174, and 178 are thicker than bottom wall 190. For example, the sides can be double-wall or triple-wall sides.

Figure 4:
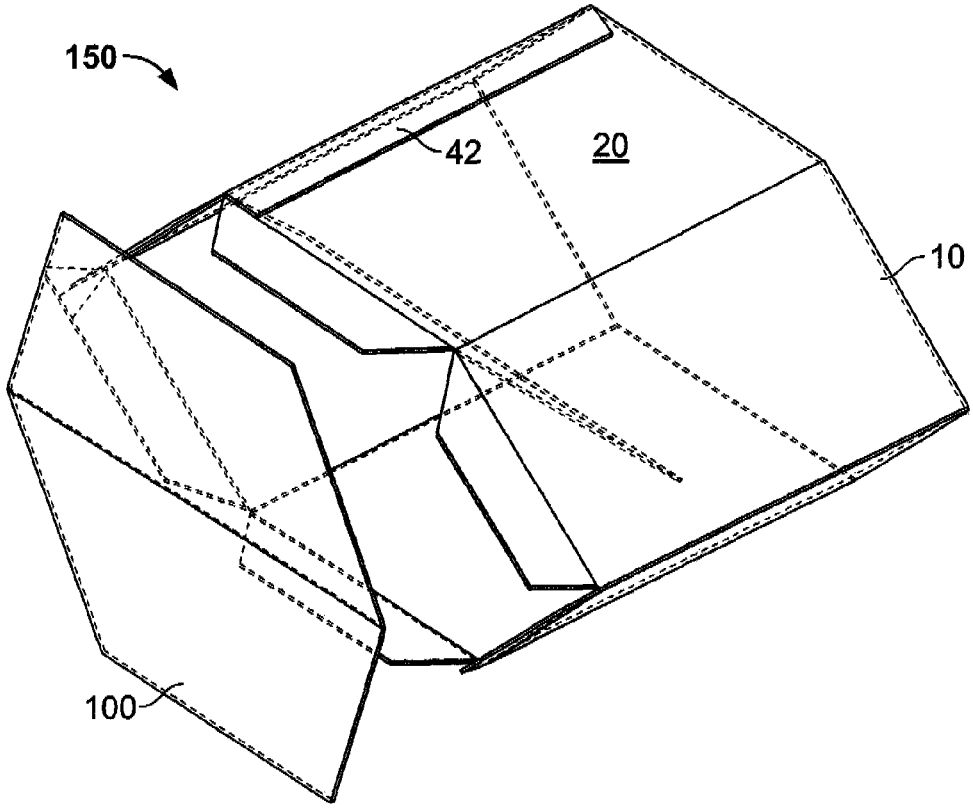
FIG. 4 is a perspective view of the first blank and the second blank in one step of assembly.

FIGS. 4-8 illustrate one exemplary method of assembling container 150. FIG. 4 is a perspective view of first blank 10 and second blank 100 in one step of assembly. Specifically, first blank 10 has been folded such that glue tab 42 is coupled to first side panel 20 to form a hexagonal body, and the hexagonal body is partially erected such that second blank 100 can be inserted therein.

Figure 5:
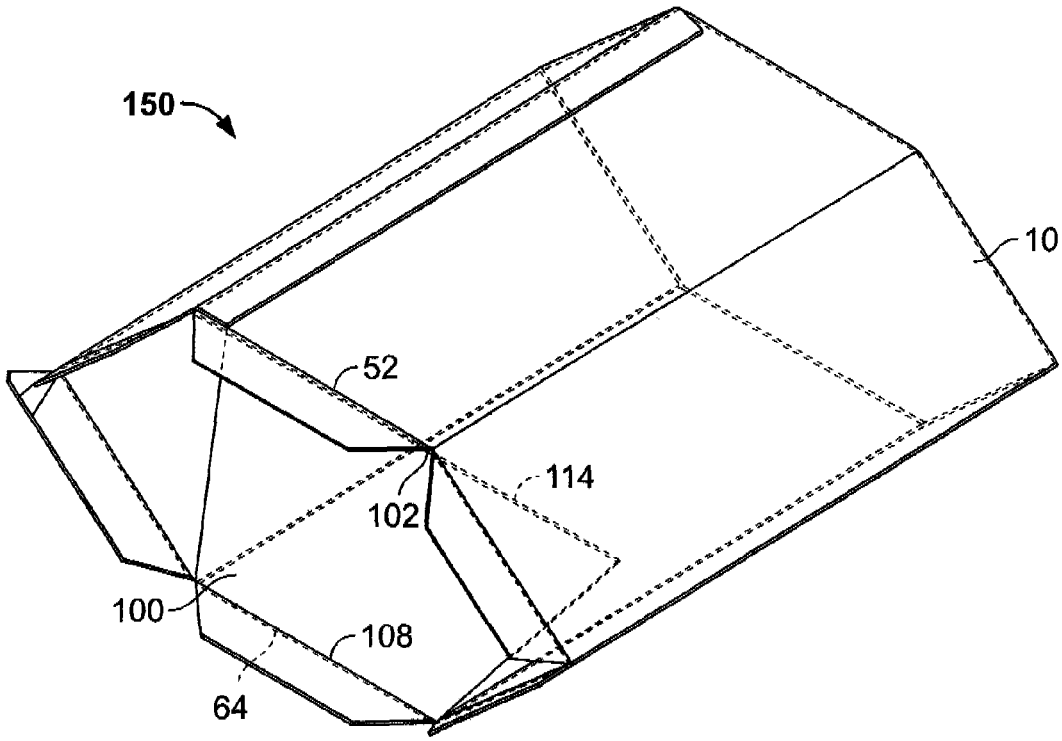
FIG. 5 is a perspective view of the first blank and the second blank in another step of assembly.

FIG. 5 is a perspective view of first blank 10 and second blank 100 in another step of assembly. Second blank 100 is folded substantially ninety degrees along fold line 114 and is inserted into blank 10. Specifically, edge 108 of second blank 100 is aligned with fold line 64 of first blank 10, and edge 102 of second blank 100 is aligned with fold line 52 of first blank 10.

Figure 6:
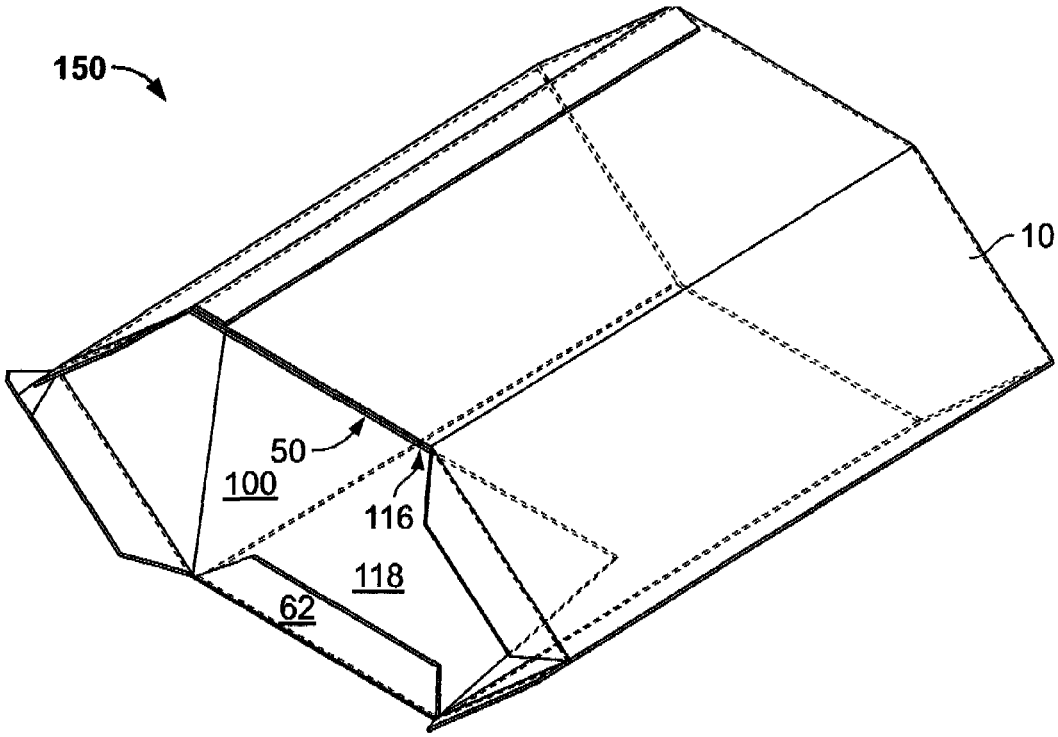
FIG. 6 is a perspective view of the first blank and the second blank in another step of assembly.

FIG. 6 is a perspective view of first blank 10 and second blank 100 in another step of assembly. Major flap 62 of first blank 10 is folded towards and adhered to panel 118 of second blank 100. Further, major flap 50 of first blank 10 is folded towards and adhered to panel 116 of second blank 100.

Figure 7:
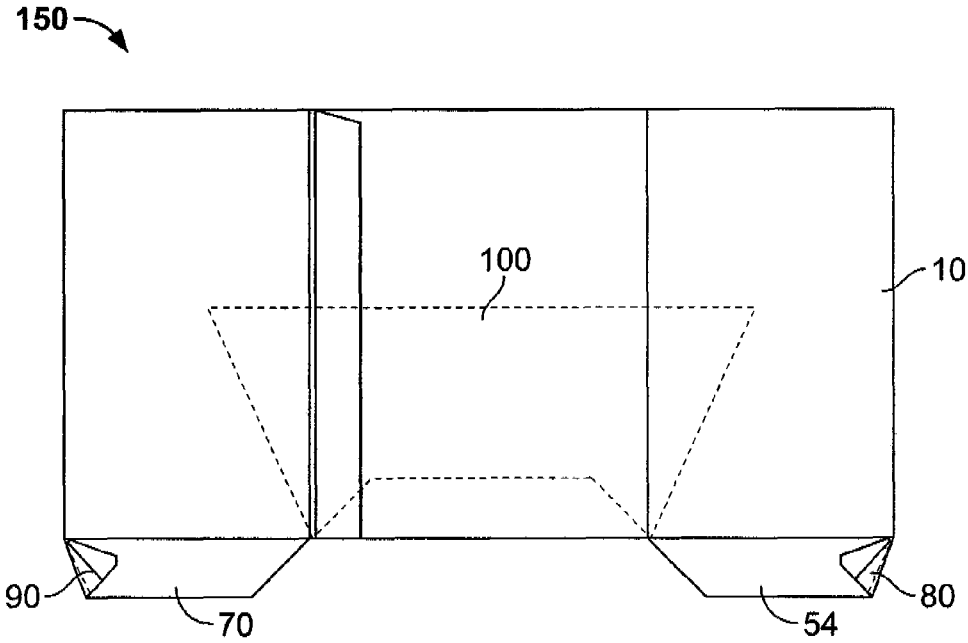
FIG. 7 is a plan view of the first blank and the second blank in another step of assembly.

FIG. 7 is a plan view of first blank 10 and second blank 100 in another step of assembly. First blank 10 is in a collapsed configuration with second blank 100 coupled thereto and positioned therein. Minor flap 90 is folded towards and adhered to major flap 70, and minor flap 80 is folded towards and adhered to major flap 54.

Figure 8:
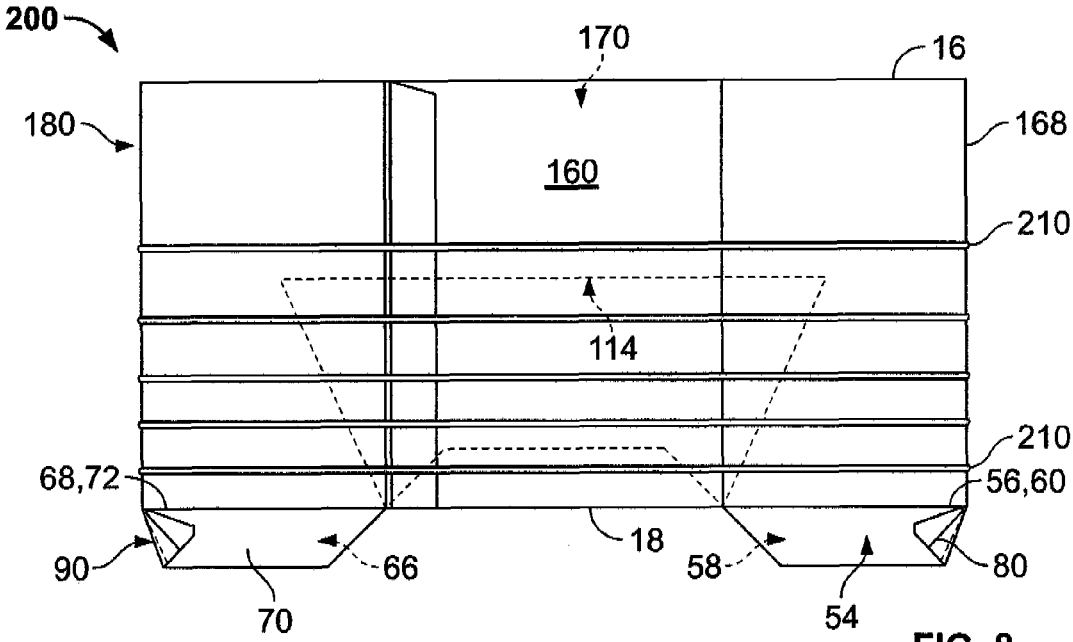
FIG. 8 is a plan view of the container of FIG. 3 in a knocked-down flat configuration and including reinforcing straps.

FIG. 8 is a plan view of an assembled knocked-down flat 200 created from blank 10 (shown in FIG. 1) and blank 100 (shown in FIG. 2) and having a plurality of reinforcing straps 210 wrapped around an exterior surface thereof. Knocked-down flat 200 requires a great deal less space to store, and less space to transport, than fully assembled container 150 (shown in FIG. 3). However, before use, knocked-down flat 200 must be articulated into a usable container. In a first embodiment, to form container 150 from knocked-down flat 200, first side wall 160 is moved out of communication with fourth side wall 170. In one embodiment, top edge 16 of first side wall 160 is pulled away from top edge 16 of fourth side wall 170. In another embodiment, bottom edge 18 of first side wall 160 is pulled away from bottom edge 18 of fourth side wall 170. In yet another embodiment, fold line 168 is pushed toward fold line 180, forcing first side wall 160 apart from fourth side wall 170.

Moving first side wall 160 out of communication with fourth side wall 170 causes blank 100 to rotate about fold line 114, removing first portion 116 (shown in FIG. 2) from communication with second portion 118 (shown in FIG. 2). Moving first side wall 160 out of communication with fourth side wall 170 also removes second end flap 54 from planar communication with third end flap 58. However, tab joint 80 remains coupled to second end flap 54. Second end flap 54 and third end flap 58 rotate about fold lines 56 and 60 respectively, into a substantially perpendicular relationship to side walls 164 and 166 (shown in FIG. 3). When fully articulated, blank 100 is in communication with, and supported by, interior surface 12 (shown in FIG. 1) of end flaps 54 and 58, which are coupled by tab joint 80.

Moving first side wall 160 out of communication with fourth side wall 170 also removes fifth end flap 66 from planar communication with sixth end flap 70. However, tab joint 90 remains coupled to sixth end flap 70. Fifth end flap 66 and sixth end flap 70 rotate about fold lines 68 and 72 respectively, into a substantially perpendicular relationship to side panels 174 and 178 (shown in FIG. 3). When fully articulated, blank 100 is in communication with, and supported by, interior surface 12 (shown in FIG. 1) of end flaps 66 and 70, which are coupled by tab joint 90.

This articulating process can be performed by a single person and without special equipment. By only requiring a single person, employment expenses may be reduced. Also, the time necessary to articulate an assembled container from a knocked-down flat may be reduced, which increases productivity. These benefits are achieved while providing a structurally stable container.

Figure 9:
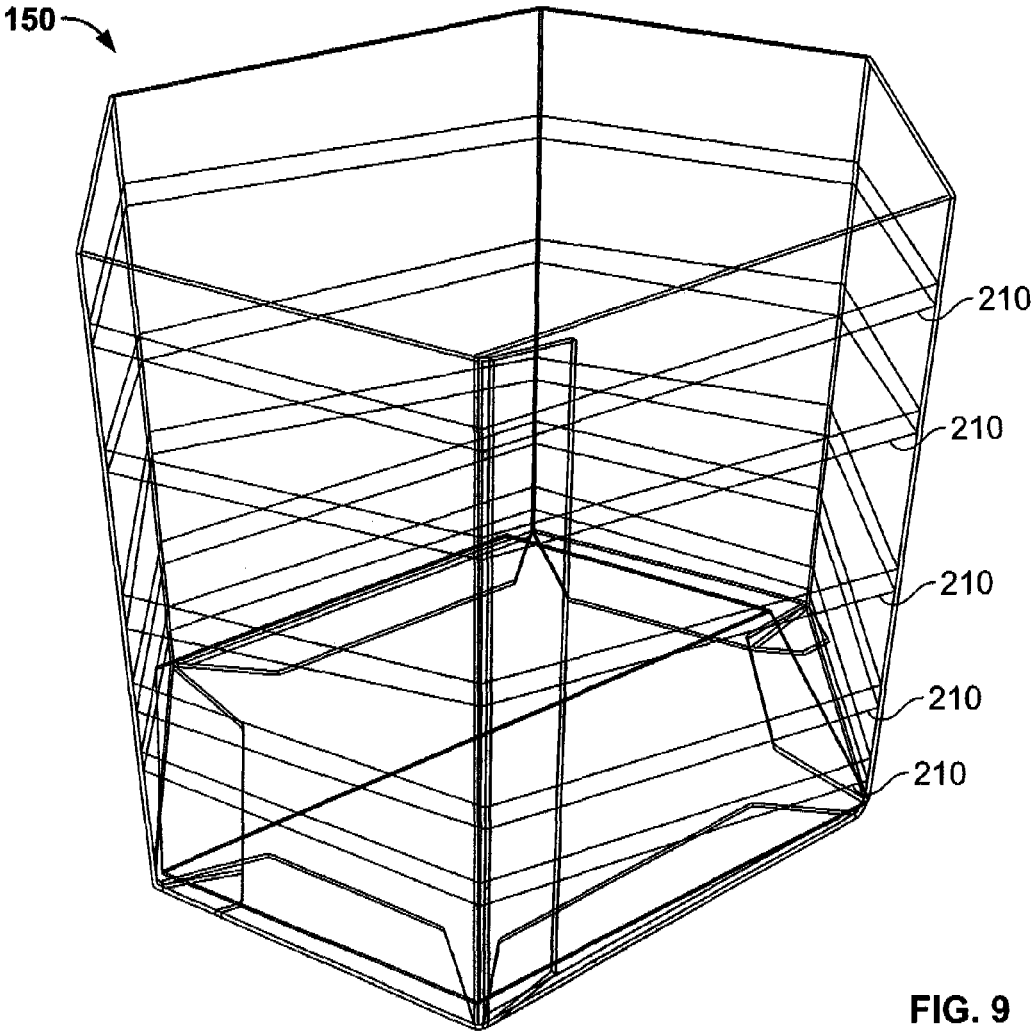
FIG. 9 is a perspective view of the container of FIG. 3, including reinforcing straps.

FIG. 9 is a perspective view of an assembled knocked-down flat 200 created from blank 10 and blank 100 and including reinforcing straps 210. When articulated container 150 is filled with a product to be stored or transported, the product applies pressure to the walls of container 150. One method of reinforcing container 150 to prevent outward bowing of the walls of container 150, is to wrap reinforcing straps 210 around container 150. In one specific example, the straps are made of plastic, but any other material of suitable strength could be utilized.

In one embodiment, the reinforcing straps are flexible plastic straps for providing girth support when the container is in an erected position. The straps are frictionally held in tension around the container vertical side walls. The girth support is provided by the horizontally placed straps at longitudinally spaced locations along the panels. In one embodiment, the straps are polypropylene plastic or of a polyester-type material which are thermally fused or welded together at their ends which secures the straps in sufficient tension outside the container panels for frictionally holding the straps to the container. In one embodiment, the plastic straps include prestretched polypropylene straps, prestretched to provide a low elongation factor and preferably to reduce a typical stretching by approximately fifty percent.

Figure 10:
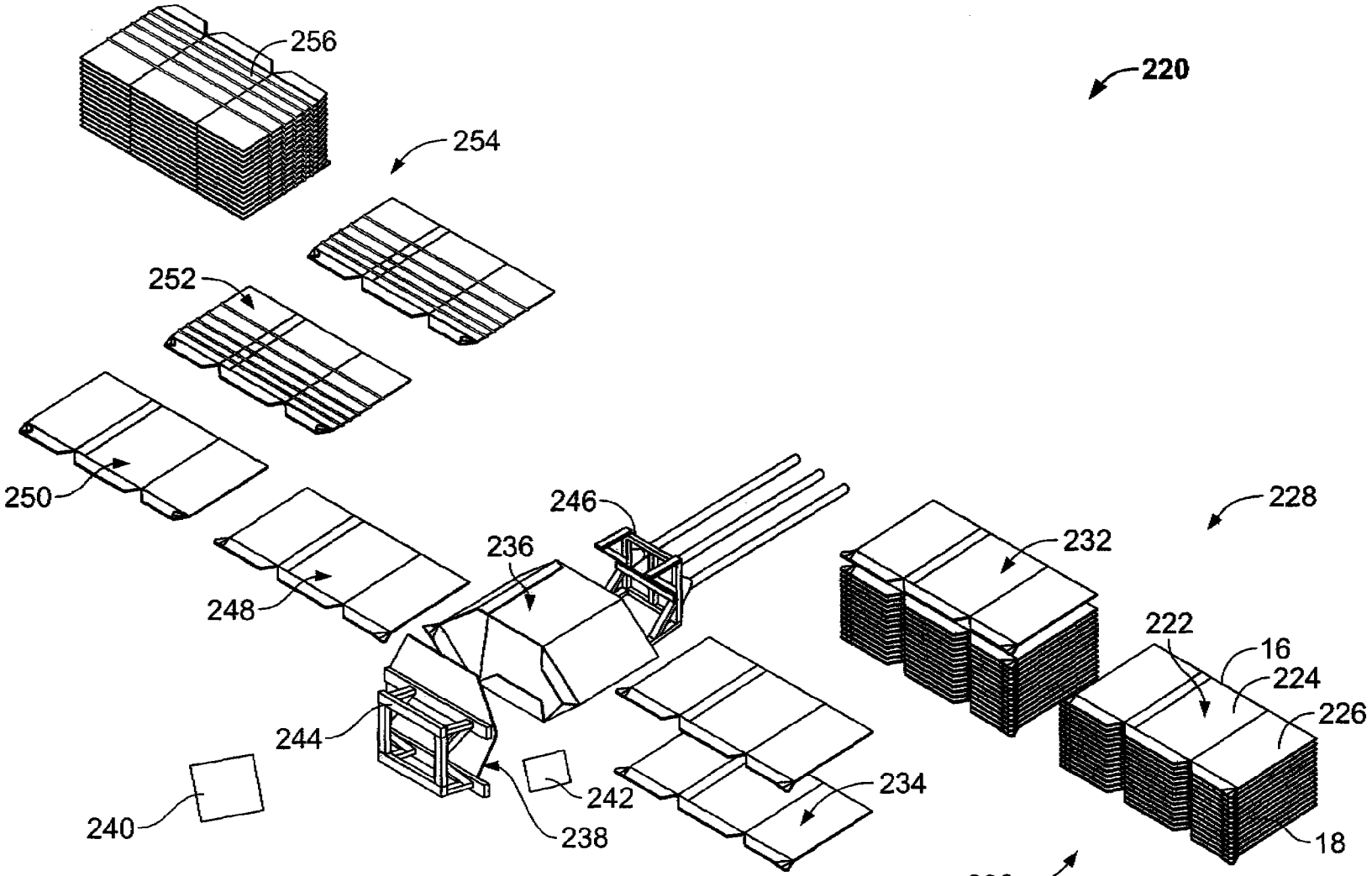
FIG. 10 is a schematic illustration of a mechanism for producing a knocked-down flat, and applying reinforcing straps around the knocked-down flat.
Figure 11:
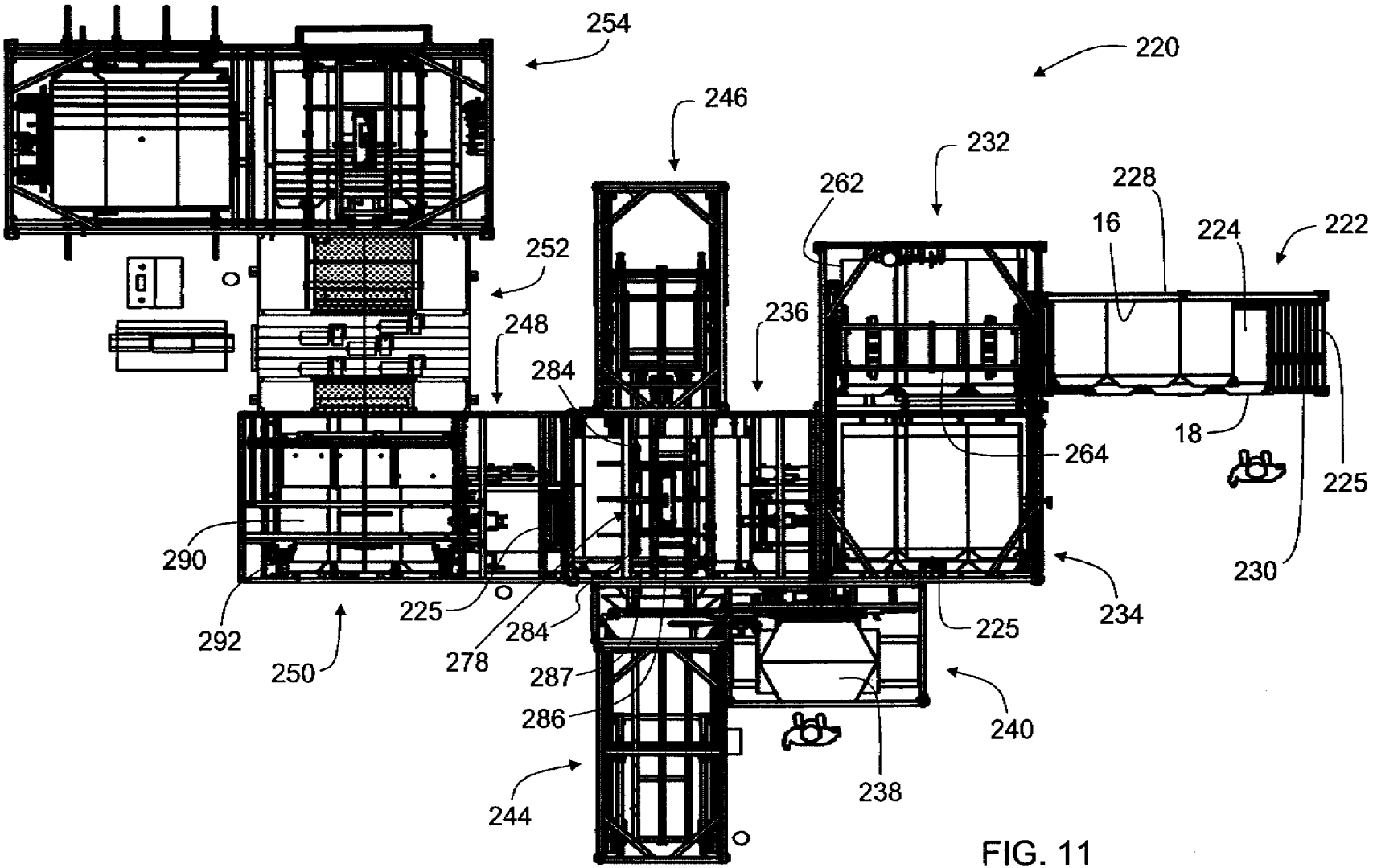
FIG. 11 is a plan view of the machine shown in FIG. 10.

FIG. 10 is a schematic illustration of a second exemplary method of forming knocked-down flat 200, and a mechanism to perform the method. More specifically, FIG. 10 is a schematic illustration of a machine 220 for producing knocked-down flat 200 and applying reinforcing straps 210 around knocked-down flat 200. FIG. 11 is a plan view of machine 220 as shown in FIG. 10.

Machine 220 includes a bin body pre-stage station 222, for receiving a stack of bin body blanks 224 (i.e., first blank of sheet material 10 of FIG. 1). Stack 224 includes a plurality of individual bin body blanks 226. In one embodiment, stack 224 includes eighty-eight bin body blanks 226. In an alternative embodiment, stack 224 includes any suitable number of blanks that may be formed by machine 220. In operation, an individual body blank 226 is provided to machine 220 for forming knocked-down flat 200. Stack 224 is provided to machine 220 with top edges 16 aligned with a first side 228 of machine 220, and bottom edges 18 aligned with a second side 230 of machine 220.

Machine 220 also includes a transport mechanism 225 to move stack 224 to a bin body feed station 232. In one embodiment, transport mechanism 225 includes at least one of a powered conveyor, rollers, and any other mechanism suitable for moving stack 224 as described herein. Bin body feed station 232 includes a scissor lift 262 to lift stack 224 towards a vacuum 264. The vacuum utilizes suction to remove one blank 226 from stack 224. Blank 226 is then moved by the vacuum to a squaring station 234. As each blank 226 is removed from stack 224, the scissor lift 262 lifts the remaining blanks 226 on stack 224, such that the next blank 226 can be removed from stack 224 by the vacuum 264. The blank 226 that has been moved to squaring station 234 is squared and lowered to a plurality of rollers 225. The plurality of rollers 225 then move blank 226 into an erecting station 236.

As each blank 226 is placed on squaring station 234 a bottom pad or bottom blank 238 (i.e., second blank of sheet material 100 of FIG. 2) is removed from a bottom pad magazine 240 and prepared for insertion into blank 226. While bottom pad 238 is positioned between bottom pad magazine 240 and erecting station 236, a glue applicator gun 242 applies glue to predetermined locations of bottom pad 238.

At erecting station 236, an erecting device 278 partially erects blank 226 such that bottom pad 238 can be inserted therein. In one embodiment, erecting device 278 includes a pair of vacuums 284 for suctioning a top portion and a bottom portion of blank 226. Further, bottom pad 238 is folded to a substantially ninety degree angle to provide a female end and a male end. An insertion mechanism 244 located at erecting station 236 is inserted into the female end of folded bottom pad 238, such that insertion mechanism 244 forces the male end of bottom pad 238 toward an opening in the partially erect blank 226. Insertion mechanism 244 continues to insert bottom pad 238 until bottom pad 238 is positioned entirely within blank 226. A first attachment device 286 then folds at least one major flap toward the glued portions of bottom pad 238 and a compression device 246 applies pressure to the portions of bottom pad 238 having glue thereon. As such, the glued portions of bottom pad 238 are forced against blank 226, such that bottom pad 238 is secured to blank 226 to form knocked-down flat 200. In one embodiment, first attachment device 286 includes a plurality of fingers 287.

Knocked-down flat 200 is then transported to a collapsing station 248 where knock-down flat 200 is collapsed with bottom pad 238 glued within blank 226. A plurality of rollers 225 then transport knocked down flat 200 to a tab joint or minor flap sealing station 250. Glue is applied to tab joints 80 and 90 and a second attachment device 290 folds tab joints 80 and 90 such that they are sealed against second end flap 54 and sixth end flap 70, respectively. In one embodiment, second attachment device 290 includes a plurality of fingers 292. Knocked-down flat 200 is then transferred to a strapping station 252 where a plurality of straps are simultaneously applied around knocked-down flat 200. Knocked-down flat 200 is then placed on a unitizing station 254 to be stacked with other knocked-down flats 200. Knocked-down flats 200 are positioned on unitizing station 254 in an alternating configuration. Specifically, a first flat 200 is positioned such that top edge 16 is aligned with first side 228 of machine 220. A second flat 200 is then positioned on top of the first flat with bottom edge 18 aligned with first side 228 of machine 220. By alternating flats 200, the weight of flats 200 is distributed to facilitate forming a level stack 256.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above-described apparatus and methods facilitate providing a bulk bin assembly capable of being erected and collapsed by a single person. Further, the above-described apparatus and methods provide a bulk bin assembly that is reinforced to facilitate providing strength against a weight of materials placed therein.

Although the apparatus and methods described herein are described in the context of a reinforced bulk bin assembly and method for making the same, it is understood that the apparatus and methods are not limited to reinforced bulk bin assemblies. Likewise, the reinforced bulk bin assembly components illustrated are not limited to the specific embodiments described herein, but rather, components of the reinforced bulk bin assembly can be utilized independently and separately from other components described herein.

While the invention has been described in terms of various specific embodiments, those skilled in the art will recognize that the invention can be practiced with modification within the spirit and scope of the claims.

What is claimed is:

1. A method for making a reinforced, collapsible bulk bin assembly, the bulk bin capable of being erected to a deployed articulated configuration, the bulk bin formed from a body blank and a bottom blank, the body blank having major bottom flaps and minor bottom flaps, the bulk bin having a bottom and a plurality of side panels extending from the bottom, said method comprising:

providing a body blank from a stack of body blanks;

partially erecting the body blank;

partially folding the bottom blank;

inserting the partially folded bottom blank into the partially erected body blank;

attaching the major flaps to the bottom blank;

collapsing the partially erected body blank;

attaching each minor flap to a major flap of the body blank after the body blank has been collapsed; and simultaneously applying a plurality of straps to an exterior surface of the body blank.

2. A method in accordance with claim 1 further comprising lifting the stack of body blanks toward a vacuum and removing one blank from the stack of body blanks utilizing the vacuum.

3. A method in accordance with claim 1 further comprising applying glue to predetermined locations of the bottom blank.

4. A method in accordance with claim 1 further comprising compressing the predetermined locations of the bottom blank against the body blank.

5. A method in accordance with claim 1 wherein partially erecting the body blank further comprises utilizing a plurality of vacuums to facilitate partially erecting the body blank.

6. A method in accordance with claim 1 further comprising stacking a plurality of reinforced, collapsed bulk bin assemblies in alternating positions to facilitate forming a level stack of reinforced, collapsed bulk bin assemblies, wherein alternating positions includes each reinforced, collapsed bulk bin included within the stack is rotated substantially 180 degrees relative to a next adjacent reinforced, collapsed bulk bin assembly within the stack.

7. A method in accordance with claim 1 further comprising advancing the body blank through portions of the machine utilizing a plurality of conveyors.

8. A machine for making a reinforced, collapsible bulk bin assembly, capable of being erected to a deployed articulated configuration, the bulk bin being formed from a body blank and a bottom blank, the body blank having major bottom flaps and minor bottom flaps, the bulk bin having a bottom and a plurality of side panels extending from the bottom, said machine comprising:

a body blank feeding device for providing a body blank from a stack of body blanks;

an erecting device for partially erecting the body blank;

a folding device for partially folding a bottom blank;

a bottom insertion device for inserting the partially folded bottom blank into the partially erected body blank;

first fingers for attaching the major flaps to the bottom blank;

a collapsing device for collapsing the partially erected body blank;

second fingers for attaching each minor flap to a major flap of the body blank after the body blank has been collapsed; and a strapping device for simultaneously applying a plurality of straps to an exterior surface of the body blank.

9. A machine in accordance with claim 1 wherein said body blank feeding device comprises a scissor lift and a vacuum, said scissor lift lifts the stack of body blanks toward said vacuum, and said vacuum removes one blank from the stack of body blanks.

10. A machine in accordance with claim 1 further comprising a glue applicator for applying glue to predetermined locations of the bottom blank.

11. A machine in accordance with claim 10 further comprising a compression device for compressing the predetermined locations of the bottom blank against the body blank.

12. A machine in accordance with claim 1 wherein the erecting device further comprises a plurality of vacuums for partially erecting the body blank.

13. A machine in accordance with claim 1 further comprising a unitizing device for stacking a plurality of reinforced, collapsed bulk bin assemblies in alternating positions to facilitate forming a level stack of reinforced, collapsed bulk bin assemblies, wherein alternating positions includes each reinforced, collapsed bulk bin included within the stack is rotated substantially 180 degrees relative to a next adjacent reinforced, collapsed bulk bin assembly within the stack.

14. A machine in accordance with claim 1 further comprising a plurality of conveyors for advancing the body blank through portions of said machine.

15. A machine for making a reinforced, collapsible bulk bin assembly, capable of being erected to a deployed articulated configuration, the bulk bin being formed from a body blank and a bottom blank, the body blank having major bottom flaps and minor bottom flaps, the bulk bin having a bottom and a plurality of side panels extending from the bottom, said machine comprising:

a body blank feeding device for providing a body blank from a stack of body blanks, the body blank feeding station comprising a vacuum device for removing one blank from the stack of body blanks;

an erecting device for partially erecting the body blank;

a folding device for partially folding a bottom blank;

a bottom insertion device for inserting the partially folded bottom blank into the partially erected body blank, said bottom insertion station comprising a glue applicator for applying glue to predetermined locations on the bottom blank and a compression device for attaching the glue locations of the bottom blank to the body blank;

a first attachment device for attaching the major flaps to the bottom blank;

a collapsing device for collapsing the partially erected body blank;

a second attachment device for attaching each minor flap to a major flap of the body blank after the body blank has been collapsed; and a strapping device for simultaneously applying a plurality of straps to an exterior surface of the body blank.

16. A machine in accordance with claim 15 wherein said body blank feeding device further comprises a scissor lift, said scissor lift lifts the stack of body blanks toward said vacuum.

17. A machine in accordance with claim 15 wherein said erecting device further comprises a plurality of vacuums for partially erecting the body blank.

18. A machine in accordance with claim 15 wherein said first attachment device comprises a first plurality of fingers for attaching the major flaps to the bottom blank, and said second attachment device comprises a second plurality of fingers for attaching each minor flap to a major flap of the body blank.

19. A machine in accordance with claim 15 further comprising a unitizing device for stacking a plurality of reinforced, collapsed bulk bin assemblies in alternating positions to facilitate forming a level stack of reinforced, collapsed bulk bin assemblies, wherein alternating positions includes each reinforced, collapsed bulk bin included within the stack is rotated substantially 180 degrees relative to a next adjacent reinforced, collapsed bulk bin assembly within the stack.

* * * * *

UNITED STATES PATENT AND TRADEMARK OFFICE

CERTIFICATE OF CORRECTION

PATENT NO. : 7,381,176 B2
APPLICATION NO. : 11/533244
DATED : June 3, 2008
INVENTOR(S) : Graham et al.

It is certified that error appears in the above-identified patent and that said Letters Patent is hereby corrected as shown below:

Column 6, line 61, delete "the scissor lift" and insert therefor --scissor lift--.

In Claim 9, column 9, line 12, delete "claim 1" and insert therefor --claim 8--.

In Claim 10, column 9, line 17, delete "claim 1" and insert therefor --claim 8--.

In Claim 12, column 9, line 24, delete "claim 1" and insert therefor --claim 8--.

In Claim 13, column 9, line 26, delete "claim 1" and insert therefor --claim 8--.

In Claim 14, column 9, line 35, delete "claim 1" and insert therefor --claim 8--.

Signed and Sealed this

Eighth Day of September, 2009

David J. Kappos

David J. Kappos
*Director of the United States Patent and Trademark Office*